US006058799A

United States Patent [19]

Bonner

[11] Patent Number: 6,058,799

[45] Date of Patent: May 9, 2000

[54] LOW TORQUE CRANKING DEVICE AND METHODS OF CONSTRUCTING AND UTILIZING SAME

[76] Inventor: Daniel Bonner, 146 Doe Run La., Brooklet, Ga. 30415

[21] Appl. No.: 08/422,840

[22] Filed: Apr. 17, 1995

[51] Int. Cl.[7] ..... G05G 1/00; G05G 5/06

[52] U.S. Cl. ..... 74/545; 74/548; 74/527

[58] Field of Search ..... 74/545–548, 527, 74/528; 16/115

[56] References Cited

U.S. PATENT DOCUMENTS

| | | | |
|---|---|---|---|
| D. 275,138 | 8/1984 | Bacon | D34/33 |
| D. 292,550 | 11/1987 | Jackson | 74/545 |
| 944,534 | 12/1909 | Beaman | 74/545 |
| 2,464,941 | 3/1949 | Rader | 74/545 |
| 2,851,295 | 9/1958 | Chaffee | 287/119 |
| 3,776,517 | 12/1973 | Davis et al. | 254/150 R |
| 4,083,259 | 4/1978 | Seliger et al. | 74/545 X |
| 4,338,827 | 7/1982 | Hooker | 74/545 |
| 4,391,432 | 7/1983 | Baud | 74/542 |
| 4,538,479 | 9/1985 | Blessing | 74/528 |
| 4,631,989 | 12/1986 | Trowbridge et al. | 81/62 |
| 4,674,355 | 6/1987 | Klein | 74/543 |
| 4,807,855 | 2/1989 | Schuitema | 74/527 |
| 4,883,255 | 11/1989 | Bacon . | |
| 5,255,573 | 10/1993 | Estabrook | 74/545 |
| 5,344,121 | 9/1994 | Baziuk | 254/358 |

*Primary Examiner*—Vinh T. Luong
*Attorney, Agent, or Firm*—Carrier, Blackman & Associates, P.C.; Joseph P. Carrier; William D. Blackman

[57] ABSTRACT

A cranking device for use with a winch having a crankable shaft, the cranking device comprising an engagement member selectively engageable with an end of the crankable shaft in a loose fitting relationship such that the engagement member may be rotated relative to the shaft end, a handle fixed to the engagement member for cranking same, a locking mechanism provided with the engagement member for locking the engagement member onto the end of the crankable shaft in the loose fitting relationship such that the shaft may be cranked together with the engagement member under relatively low torque. Additionally, the engagement member is preferably formed as a socket having a plurality of spacer members provided on an inner surface thereof for engaging the shaft end when the socket is fitted thereover such that a gap is defined between an outer periphery of the shaft and an inner periphery of the socket.

20 Claims, 2 Drawing Sheets

LOW TORQUE CRANKING DEVICE AND METHODS OF CONSTRUCTING AND UTILIZING SAME

BACKGROUND OF THE INVENTION

1. Field of the Invention

The present invention pertains to a cranking device for use in cranking winch mechanisms. More particularly, the present invention pertains to a low torque cranking device for use in quickly and easily rewinding unloaded, industrial type winches, such as the winches conventionally used to secure loads on flatbed trailers.

2. Description of Relevant Art

Winches are conventionally known, as are cranking handles usable together with the winches. Typically the winch includes a rotatable shaft having a relatively long cable or strap wound thereon, a ratchet mechanism associated with one end of the shaft for selectively preventing the shaft from being rotated in a direction in which the cable or strap is unwound, and a crank or crank handle associated with the opposite end of the shaft for rotating the shaft in one or both directions, The crank or crank handle is conventionally required to be tightly fitted over or within the end of the winch shaft so that it can apply a sufficiently high torque to the shaft for rewinding the cable or strap when the cable or strap is loaded.

Some conventional winches, winch handles and crank handles are, for example, disclosed in U.S. Pat. No. 944,534 (Beaman); U.S. Pat. No. 2,464,941 (Rader); U.S. Pat. No. 4,338,827 (Hooker); U.S. Pat. No. 4,391,432 (Baud); Design Pat. No. 275,138 (Bacon); U.S. Pat. No. 4,674,355 (Klein); Design Pat. No. 292,550 (Jackson); U.S. Pat. No. 4,883,255 (Bacon); U.S. Pat. No. 5,255,573 (Estabrook); and U.S. Pat. No. 5,344,121 (Baziuk).

With reference to FIG. 4 of the present drawings, there is shown (together with a low torque cranking device according to the invention) an industrial type winch 100 such as conventionally provided on a flatbed trailer for securing loads on a trailer. The winch is constructed of heavy duty materials such as heavy gauge steel and includes a shaft rotatably supported by a bracket 102 that would be fixed to a trailer (not shown), a heavy duty nylon strap 104 which is 4–8 inches wide by 20–50 feet long and wound on the shaft, a ratchet mechanism 106 provided on one end of the shaft, and an enlarged hollow head 108 provided on the opposite end of the shaft. The hollow head is typically cylindrical in shape and includes a plurality of openings 110 (typically four or six) defined through a side wall thereof and which are shaped to snugly receive the end of an elongate bar or rod (not shown) therethrough such that the bar or rod extends perpendicularly to a longitudinal axis of the winch shaft. In use, the nylon strap will be unwound from the winch, laid over a load disposed on the trailer bed, the free end of the strap is secured on the opposite side of the trailer from the winch, and the winch is cranked using the elongate bar so as to tighten the strap about the load. When the elongate bar is fitted to the enlarged head of a winch shaft, an operator can apply a relatively large cranking torque to the winch shaft, which is necessary for adequately tightening the nylon strap about the load, because significant leverage is established due to the length of the bar.

On the other hand, after the nylon strap has been released from a load the elongate bar cannot practically be used for rewinding the unloaded strap onto the winch shaft due to the significant length of the bar. Particularly, each time the bar is cranked to rotate the winch shaft through a certain angle, such as 90°–180°, the end of the bar would have to be removed from an opening of the shaft head, and inserted in a different opening, and this process would have to be repeated until the strap is fully rewound. Such process of repeatedly inserting, rotating and removing the elongate bar is simply too tedious and time consuming so that operators have conventionally not used the elongate bar to rewind the unloaded strap, and instead have simply resorted to cranking the winch shaft by hand so as to rewind the nylon strap. Such hand cranking of the winch shaft is less tedious and time consuming than using the elongate bar, but it is still not very fast and somewhat tedious.

Moreover, with use of the industrial type winches over a long period of time, as is normal given their industrial-type construction, metal burrs are created by the elongate bar in the side wall of the enlarged crankshaft head around the openings where the bar is inserted through the head and cranked. Such burrs are a hazard if contacted directly by an operator's hand, and otherwise become larger and more numerous the more the winch is used.

The present invention has been developed to overcome the problems and disadvantages of known winches and winch handles as discussed above, and to generally fulfill a great need in the art for a simple mechanism which may be used with conventional industrial-type winches of the discussed type for conveniently and rapidly rewinding an unloaded winch strap or cable.

SUMMARY OF THE INVENTION

According to the invention there is provided a cranking device for use with a winch having a crankable shaft, the cranking device comprising an engagement member selectively engageable with an end of a crankable shaft of a winch in a loose fitting relationship such that the shaft may be rotated relative to the engagement member, a cranking handle fixed to the engagement member for cranking the engagement member, and locking means provided with the engagement member for locking the engagement member onto the end of the crankable shaft in the loose fitting relationship such that the shaft may be cranked together with the engagement member under low torque. Preferably, the engagement member will include a socket shaped to fit over the end of the crankable shaft, the crankable shaft will have an opening defined therein, and the locking means will include a retractable pin shaped to loosely fit within the opening in the crankable shaft head, biasing means for normally urging the pin within the opening, and a retracting handle connected to the pin for manually retracting the pin from the opening.

Also preferably the socket or engagement member will have spacer means provided on an inner surface thereof for engaging the crankable shaft when fitted thereover such that a gap is defined between an outer periphery of the shaft and an inner periphery of the socket, and the socket, handle, and spacer means will be preferably formed as a compact, integral, unitary member.

It is an object of the present invention to provide a simple, compact cranking device for use in quickly and easily rewinding an unloaded strap or cable of an industrial-type winch under low torque.

It is another object of the present invention to provide such a cranking device having a simple locking mechanism for reliably locking the device onto the winch.

It is still another object of the invention to provide such a cranking device which may be used with different sized winches or with winches whose shape has been distorted through extended use.

It is yet another object of the invention to provide such a cranking device which is very durable in construction, and yet economical to produce.

Other objects, advantages, and salient features of the invention will become apparent from the following detailed description which, when viewed in conjunction with the annexed drawings, discloses preferred embodiments of the invention.

DETAILED DESCRIPTION OF THE PREFERRED EMBODIMENTS

Figure 1:
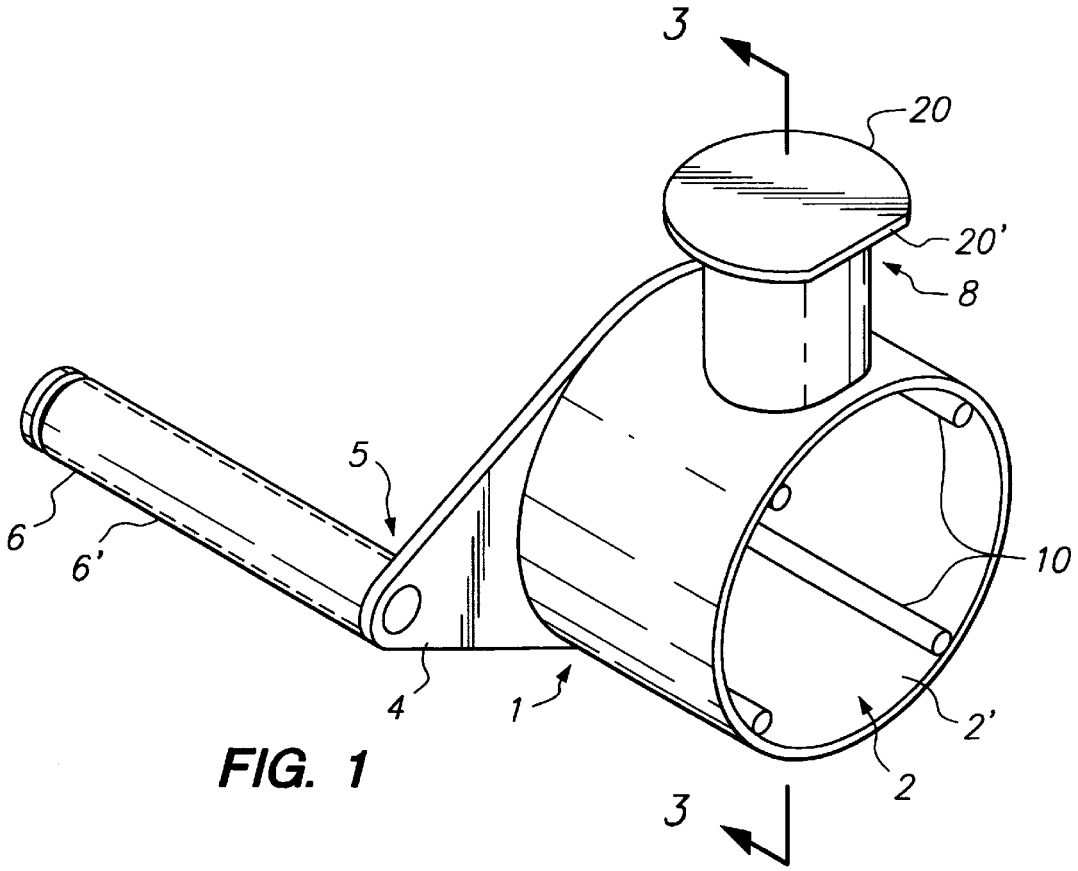
FIG. 1 is a perspective view of a cranking device according to a first preferred embodiment of the invention.
Figure 2:
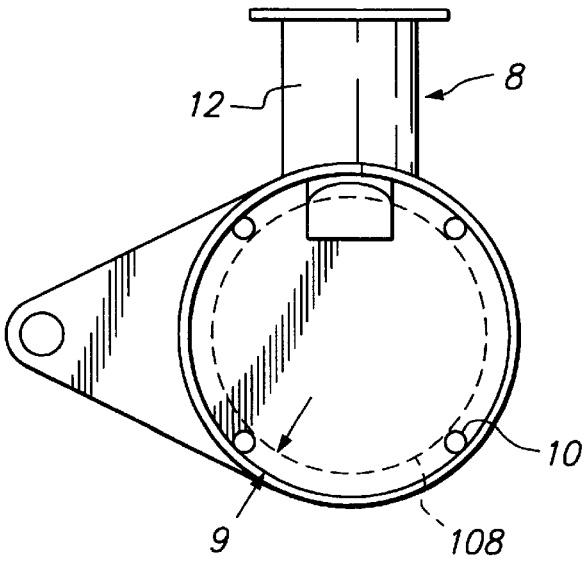
FIG. 2 is an end view of the cranking device in FIG. 1, and wherein an outline of a winch crank shaft over which the cranking device is fitted is shown in broken lines.
Figure 3:
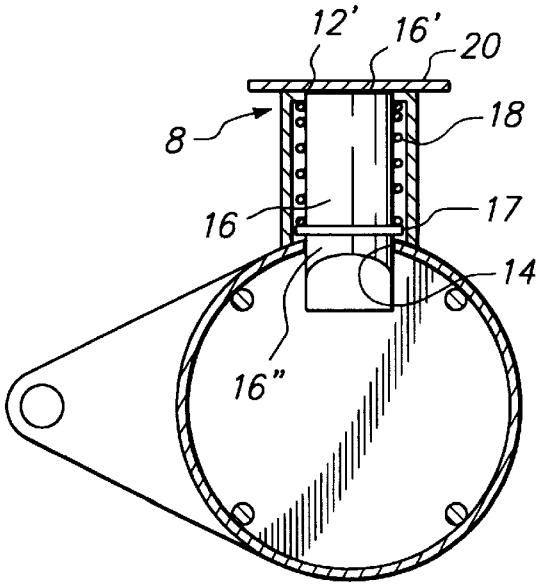
FIG. 3 is a sectional side view of the cranking device looking in a direction of line 3—3 in FIG. 1.

Referring to FIGS. 1–3, there is shown a cranking device 1 according to a first preferred embodiment of the invention. The device includes an engagement member 2, sized and shaped to fit over the enlarged end of a crankable shaft of a winch, such as the end 108 of shaft 109 (shown in broken lines) in FIG. 4, in a loose fitting relationship, a cranking handle 5 consisting of a first handle member 4 fixed to one end of the engagement member, and a second handle member 6 connected to a projecting end of the first handle member, and a locking means 8 provided on a side wall of the engagement member for locking the engagement member onto the end of the crankable shaft. The engagement member 2 consists of a socket 2 having the same shape as but being slightly larger in size than an enlarged end 108 of the crankable shaft 109 of a winch 100 (see FIG. 4), typically cylindrical, and a plurality of spacer members 10 fixed on an inner surface of the socket extending parallel to a longitudinal axis of the socket and spaced equally from each other around the inner circumferential surface of the socket. Due to its relative size, the socket easily slips onto the enlarged end 108 of the crankable shaft in a loose fitting relationship, and were it not for the locking means 8 the socket would be rotatable relative to the enlarged shaft end. As depicted, the spacer members 10 preferably comprise small diameter rods which are fixed to the inner surface of the socket through welding or the like. Four of the rods are shown in the depicted embodiment, but it is appropriate to have different numbers of the spacer members such as three or five, while the spacer members could be formed integrally as projections on the inner surface of the socket through casting, molding, etc. rather than being separate members fixed to the socket through welding or the like.

When the socket having the spacer members therein is fitted over the enlarged shaft end 108, a gap g (see FIG. 2) is defined between the inner periphery of the socket and the outer periphery of the enlarged shaft end 108. Such gap g is an important aspect of the present invention because the enlarged shaft end may have burrs formed thereon from being cranked with an elongate bar over extensive periods of use, as discussed above, and the gap permits the socket to be easily fitted over the enlarged shaft end even when the shaft end has significant burrs thereon. The overall size of the socket and the spacer members provided therein is such that the socket is rotatable relative to the enlarged shaft end in a loose fitting relationship when the locking means 8 is retracted or in an unlocked position there of. For example, a socket formed of ⅛-inch steel with a 3-inch outside diameter and 2 inches long, and having 3/16-inch steel rod for spacer members will fit loosely over the enlarged shaft end of the industrial-type winches conventionally used on most flatbed trailers, again, such that the socket can be rotated relative to the enlarged shaft end when the locking means is retracted.

The first handle member 4 of the cranking handle is preferably formed with a teardrop shape as shown such that the wide end thereof completely covers one face of the socket member to which it is connected, while the narrow end of the first handle member projects slightly from a side wall of the socket member perpendicular to a longitudinal axis of the socket member. For example, if the socket is 3 inch o.d., the narrow end of the first handle member will preferably project 1–2 inches therefrom. The second handle member 6 is fixed to the narrow, projecting end of the first member 4, extending perpendicularly thereto so that it can be gripped and cranked by an operator. The first and second handle members of the cranking handle are preferably formed of a durable material such as steel, the first handle member is preferably fixed to the end of the socket by welding or the like, and the second handle member is preferably fixed to the first handle member through welding, or by having an end thereof inserted through an opening defined in the first handle member and flattened. Alternatively, the first handle member, and perhaps the second handle member, may be formed integrally with the socket as a unitary member through casting or the like. Optionally, the second handle member will have a tubular sleeve 6' disposed thereover (see FIG. 1) which is rotatable relative thereto for facilitating cranking motions of the second handle member. Such sleeve is confined between the first handle member and an enlarged end of the second handle member and may be constructed of plastic, metal or any desired material.

Figure 6:
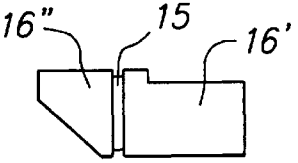
FIG. 6 is a side elevational view of a pin member of the cranking device in FIGS. 1–3.
Figure 7:
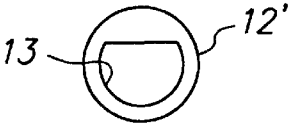
FIG. 7 is a plan view of an upper end of a housing of the biasing means in FIG. 3.
Figure 4:
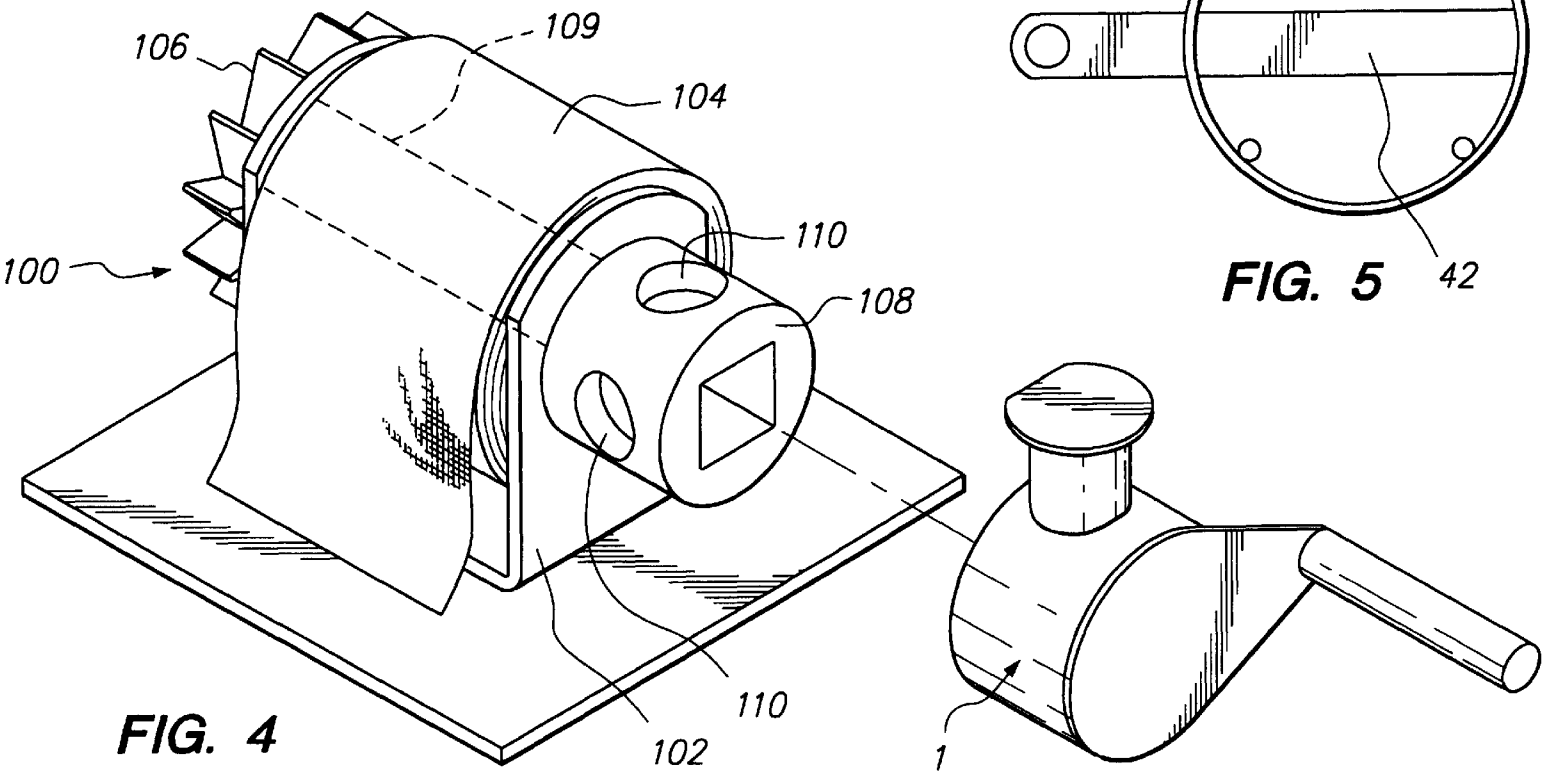
FIG. 4 shows the cranking device of FIG. 1 and a conventional winch to which it is to be attached.

The locking means 8 preferably comprises a cylindrically shaped housing 12 fixed to an outer surface of the side wall of the socket in surrounding relation to an opening 14 defined through the socket side wall, a pin member 16 which is movable into and through the opening 14, a biasing means 18 disposed about an upper end of the pin member for normally urging the pin member through the opening, and a retracting handle 20 secured to the upper end of the pin member for manually lifting or retracting the pin member 16 up through the opening 14 against the force of the biasing means. The cylindrical housing 12 is fixed to the socket side wall through welding or the like or may be formed integrally with the socket through casting, molding or the like, while an upper or outer end 12' of the cylindrical member is bent inwardly toward the pin member such that it functions as a stop for the outer end of the biasing means 18, which is preferably a coil spring as shown. As shown in FIG. 7, the outer end 12' of the housing 12 has an opening 13 defined therethrough which is substantially circular with a flat edge. The opening 13 is shaped the same as the cross section of an upper portion 16' of the pin 16 (see FIG. 6), discussed further below, so as to prevent the pin 16 and attached retracting handle 20 from being rotated. The pin member preferably includes the recessed upper portion 16' fixed to the handle 20, shaped to fit through the opening 13, and having the coil spring disposed thereabout, and a lower portion 16" which projects through the opening in the socket side wall. The upper end of the lower portion 16" functions as a stop for limiting outward movement of the pin through the opening 13, while an annular groove 15 (see FIG. 6) is formed at an intermediate section of the lower portion 16" and a snap ring 17 (see FIG. 3) is disposed in the groove 15 for limiting inward movement of the pin through the opening 14. The inner or lower end of the lower portion 16" of the pin is preferably tapered or beveled to a point, as shown, such that the pin is self-locating within the openings 110 of the enlarged shaft end 108 of the winch (see FIG. 4). The retracting handle 20 of the locking means may be a substantially planar member as shown, with a diameter larger than that of the housing member so that it can be easily gripped by an operator, and if it is so structured, an edge 20' thereof will preferably be cut or flattened as shown in FIGS. 1 and 4 so that it does not project beyond the end of the socket member. If it were to extend beyond the open end of the socket member, it might undesirably catch on the shaft support bracket of the winch when the socket is placed over the enlarged end of the winch shaft and cranked. Again, the opening 13 in the housing outer end 12' and the pin outer end 16' are identically shaped to prevent rotation of the handle 20.

As discussed above, the cranking device according to the first preferred embodiment is preferably constructed of rugged, durable materials such as steel, cast iron or other metals so that it may be reliably used over a long period of time. Alternatively, the cranking device could be molded of high impact plastics or fiber-reinforced plastics, for example. If so molded of plastics, the socket, the spacer members 10, the cranking handle and the housing 12 of the locking means 8, or some combination thereof, will preferably be molded as an integral, unitary member.

The cranking device 1 according to the first preferred embodiment is relatively compact, which is very desirable for storage and transporting of the device, and is otherwise well suited to the task of simply rewinding the unloaded strap or cable of a winch because only a small torque is required for rewinding the unloaded strap or cable. Additionally, because the cranking device has few moving parts, i.e., only the pin and spring of the locking means and the optional rotatable sleeve 6' of the second handle member, it is reliable for use over an extended period of time.

For use of the cranking device 1 according to the invention, an operator need only retract the pin 16 of the locking means by pulling on the retracting handle 20 connected to the pin, slide the socket 2 over the enlarged end 108 of a winch shaft, release the handle of the locking means, and slightly rotate the socket on the shaft end until the tapered end of the locking pin locates itself in one of the openings 110 in the enlarged shaft end. The operator then simply cranks the second handle member 6 of the cranking handle until the strap or cable of the winch is fully rewound, and removes the socket from the winch shaft end by again pulling on the retracting handle 20 to retract the locking pin out of the opening in the shaft end and sliding the socket off the shaft end.

In terms of size, the larger diameter portion of the locking pin is preferably smaller than the diameter of the openings 110 in the enlarged shaft end, such that there is again a loose fitting relationship between the locking pin and the openings in the winch shaft end. This facilitates mounting of the cranking device on the winch shaft end, and is otherwise appropriate for cranking the winch shaft under low torque. On the other hand, such loose fitting relationship would be inappropriate for cranking the winch shaft under high torque because the pin 16 would become off-centered within the openings 110, tend to be damaged, and tend to move out of the openings 110 under high torque.

Although the winch shaft end and the socket of the cranking device are depicted as having a circular cross section in the preferred embodiment, it will be understood that other shapes could also be used.

Figure 5:
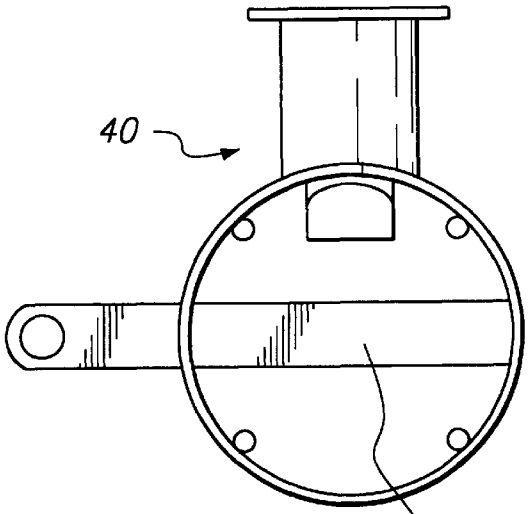
FIG. 5 is a perspective view of a cranking device according to a second preferred embodiment of the invention.

Referring to FIG. 5 of the drawings, there is shown a cranking device 40 according to a second preferred embodiment of the invention. The second preferred embodiment is substantially identical to the first preferred embodiment in all aspects except in the shape of a first handle member 42 of a cranking handle so only such first handle member 42 will be discussed in relation to this second embodiment. As shown, the first handle member 42 is a substantially rectangularly shaped piece of metal such as steel or the like which is fixed across an open end of the socket so as to partially enclose same, and which has a projecting end to which the second handle member is fixed. Use of the cranking device according to the second preferred embodiment is the same as the use of the cranking device according to the first preferred embodiment.

Although there have been disclosed what are at present considered to be the preferred embodiments of the invention, modifications and variations may be made thereto without departing from the spirit and essence of the invention. The scope of the invention is, therefore, indicated by the appended claims rather than by the foregoing description.

I claim:

1. A cranking device for use with a winch having a crankable shaft, the cranking device comprising:

an engagement member selectively engageable with an end of the crankable shaft of the winch in a loose fitting relationship such that the engagement member may be rotated relative to the shaft;

a cranking handle fixed to the engagement member for cranking the engagement member; and locking means provided with the engagement member for locking the engagement member onto the end of the crankable shaft in the loose fitting relationship such that the shaft may be cranked together with the engagement member under low torque.

2. A cranking device according to claim 1, wherein said engagement member is a socket shaped to fit over the end of the crankable shaft, the end of the crankable shaft has an opening defined therein, and said locking means includes a pin selectively movable within the shaft opening.

3. A cranking device according to claim 2, wherein said pin is shaped to loosely fit within said shaft opening.

4. A cranking device according to claim 2, wherein said locking means further includes biasing means for normally urging said pin within said socket, and a retracting handle connected to said pin for manually retracting the pin relative to said socket.

5. A cranking device according to claim 4, wherein: said socket has an opening defined through a side wall thereof, and said locking means is fixed to said side wall such that said pin is movable through said opening in the side wall.

6. A cranking device according to claim 5, wherein said locking means further includes a housing member connected to said socket side wall in surrounding relation to said opening in the side wall, said pin and said biasing means are disposed within said housing.

7. A cranking device according to claim 6, wherein said socket and said housing member are formed as an integral unitary member.

8. A cranking device according to claim 6, wherein said socket, said housing member and said cranking handle are formed as an integral unitary member.

9. A cranking device according to claim 2, wherein an inner end of said pin is tapered so that the pin is self-locating in said shaft opening, and said pin is non-rotatable relative to said socket.

10. A cranking device according to claim 2, wherein said socket has spacer means provided on an inner surface thereof for engaging the end of the shaft when the socket is fitted thereover such that a gap is defined between an outer periphery of the shaft end and an inner periphery of said socket.

11. A cranking device according to claim 10, wherein said spacer means includes a plurality of projections extending longitudinally along the inner surface of the socket.

12. A cranking device according to claim 1, wherein said cranking handle includes a first member fixed to one end of said engagement member and projecting slightly therefrom, and a second member connected to a projecting end of said first member and extending substantially perpendicularly thereto.

13. A cranking device for use with a winch having a crankable shaft, the cranking device comprising:

an engagement member selectively engageable with an end of the crankable shaft of the winch in a loose fitting relationship such that the engagement member may be rotated relative to the shaft;

a cranking handle fixed to the engagement member for cranking the engagement member;

locking means provided with the engagement member for locking the engagement member onto the end of the crankable shaft in the loose fitting relationship such that the shaft may be cranked together with the engagement member under low torque;

said cranking handle including a first member fixed to one end of said engagement member and projecting slightly therefrom, and a second member connected to a projecting end of said first member and extending substantially perpendicularly thereto; and said second member of said cranking handle having a sleeve provided thereover which is rotatable relative thereto.

14. A cranking device for use with a winch having a crankable shaft, the cranking device comprising:

an engagement member selectively engageable with an end of the crankable shaft of a winch, the engagement member including the socket shaped to fit over the end of the crankable shaft and spacer means provided on an inner surface of the socket for engaging the shaft end when the socket is fitted thereover such that a gap is defined between an outer periphery of said shaft end and an inner periphery of said socket;

locking means provided with the engagement member for locking the engagement member onto the end of the crankable shaft; and a cranking handle fixed to the engagement member for cranking the engagement member.

15. A cranking device according to claim 14, wherein said spacer means includes a plurality of projections disposed in a spaced relationship about the inner periphery of the socket.

16. A cranking device according to claim 14, wherein said engagement member fits over the end of the crankable shaft in a loose fitting relationship so as to be rotatable relative to said shaft end when placed thereover.

17. A cranking device according to claim 14, wherein said socket has an opening defined through a side wall thereof, and said locking means includes a pin selectively movable into the socket through the opening in the side wall.

18. A cranking device according to claim 17, wherein said locking means further includes biasing means for normally urging said pin within said socket and a retracting handle connected to the pin for selectively retracting the pin relative to the socket.

19. A cranking device according to claim 17, wherein an inner end of said pin is tapered so that the pin is self-locating in the opening in said shaft end, and said pin is non-rotatable relative to said socket.

20. A cranking device according to claim 18, wherein said locking means further includes a housing member connected to said socket side wall in surrounding relation to said opening in the side wall, said pin and said biasing means are disposed within said housing member.

* * * * *